US011291961B2

(12) United States Patent
Motohashi et al.

(10) Patent No.: US 11,291,961 B2
(45) Date of Patent: Apr. 5, 2022

(54) STIRRING APPARATUS

(71) Applicant: SEIKO EPSON CORPORATION, Tokyo (JP)

(72) Inventors: Koji Motohashi, Nagano (JP); Makoto Sato, Nagano (JP); Takashi Abe, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/902,307

(22) Filed: Jun. 16, 2020

(65) Prior Publication Data

US 2020/0398236 A1 Dec. 24, 2020

(30) Foreign Application Priority Data

Jun. 18, 2019 (JP) ..... JP2019-112944

(51) Int. Cl.

| | |
|---|---|
| ***B01F 7/16*** | (2006.01) |
| ***B01F 7/18*** | (2006.01) |
| ***D21B 1/06*** | (2006.01) |
| ***D21B 1/34*** | (2006.01) |
| ***B01F 7/00*** | (2006.01) |

(52) U.S. Cl.

CPC ..... *B01F 7/162* (2013.01); *B01F 7/0025* (2013.01); *B01F 7/165* (2013.01); *B01F 7/18* (2013.01); *D21B 1/063* (2013.01); *B01F 2215/0078* (2013.01); *D21B 1/34* (2013.01)

(58) Field of Classification Search

CPC ..... B01F 2215/0078; B01F 7/0025; B01F 7/162; B01F 7/165; B01F 7/18; D21B 1/063; D21B 1/34

See application file for complete search history.

(56) References Cited

U.S. PATENT DOCUMENTS

| | | | | | |
|---|---|---|---|---|---|
| 1,772,640 | A * | 8/1930 | Smith | B01F 7/165 | 366/331 |
| 1,879,828 | A * | 9/1932 | Smith | B01F 7/165 | 366/194 |
| 2,858,117 | A * | 10/1958 | Girton | B01F 7/165 | 366/312 |
| 3,054,565 | A * | 9/1962 | Willems | B01F 7/166 | 241/46.06 |
| 3,201,095 | A * | 8/1965 | Erwien | A47J 43/046 | 366/314 |
| 3,211,434 | A * | 10/1965 | Pickles | B02C 13/2804 | 366/343 |
| 3,337,193 | A * | 8/1967 | Berker | B01F 7/165 | 366/327.1 |
| 3,531,092 | A * | 9/1970 | Praschak | B01F 15/00824 | 366/177.1 |

(Continued)

FOREIGN PATENT DOCUMENTS

| | | |
|---|---|---|
| EP | 3753629 | * 12/2020 |
| GB | 1102728 A | 2/1968 |
| JP | 2011-241497 A | 12/2011 |

*Primary Examiner* — Tony G Soohoo

(74) *Attorney, Agent, or Firm* — Global IP Counselors, LLP

(57) ABSTRACT

A stirring apparatus includes a case that houses fiber pieces containing fibers, and a rotary body that is disposed inside the case and that stirs the fiber pieces, in which the rotary body includes a rotary portion that forms a portion of a bottom surface of the case and that rotates, and blades that stand upright on the rotary portion.

10 Claims, 7 Drawing Sheets

(56) References Cited

U.S. PATENT DOCUMENTS 3,559,959 A 2/1971 Davis et al.
RE27,214 E * 11/1971 Nakahara ..... B01J 2/14 264/15
3,671,296 A * 6/1972 Funakoshi et al. ..... B01J 2/10 427/212
3,674,241 A * 7/1972 Eirich ..... B01F 7/32 366/105
3,863,904 A * 2/1975 Milik ..... B01F 7/162 366/6
3,920,228 A * 11/1975 Klauk ..... A47J 27/14 366/313
4,085,002 A * 4/1978 Pettersson ..... B01F 7/165 162/238
4,098,494 A * 7/1978 Howlett ..... B01F 7/165 366/144
4,158,597 A * 6/1979 Pettersson ..... B01F 7/162 162/238
4,357,111 A * 11/1982 Honemeyer ..... B01F 7/16 241/282.1
4,435,084 A * 3/1984 Calhoun ..... B01F 7/162 366/130
4,460,277 A * 7/1984 Schulz ..... B29B 17/0412 366/76.3
4,556,175 A * 12/1985 Motoyama ..... B01J 2/16 241/57
4,623,098 A * 11/1986 Motoyama ..... B05B 15/25 241/46.04
RE32,307 E * 12/1986 Glatt ..... B01J 2/16 34/369
4,648,719 A * 3/1987 Roben ..... B01F 7/162 241/46.17
4,740,390 A * 4/1988 Kulling ..... B01J 8/382 427/213
4,834,299 A * 5/1989 Kishibata ..... B01J 2/16 241/39
4,895,733 A * 1/1990 Imanidis ..... B01J 2/14 118/303
4,941,749 A * 7/1990 Bouchez ..... B01F 15/068 165/92
4,941,750 A * 7/1990 Bouchez ..... B01F 7/00275 366/147
4,967,688 A * 11/1990 Funakoshi ..... B01J 2/16 118/303
5,011,640 A * 4/1991 Zanchetta ..... A61J 3/005 23/313 R
5,018,671 A * 5/1991 Tanimoto ..... B01J 2/10 241/16
5,030,400 A * 7/1991 Danielsen ..... B01J 2/16 264/101
5,085,170 A * 2/1992 Huttlin ..... B01J 2/16 118/303
5,132,142 A * 7/1992 Jones ..... B01J 2/006 118/24
5,296,265 A * 3/1994 Okuma ..... B01J 2/006 118/303
5,350,567 A * 9/1994 Takeda ..... B01J 2/14 118/665
5,507,871 A * 4/1996 Morino ..... B01J 2/14 118/680
5,522,989 A * 6/1996 Hove ..... B01F 7/00466 210/219
5,577,675 A * 11/1996 Ishikawa ..... B01F 7/00208 241/172
5,582,643 A * 12/1996 Takei ..... A23P 20/18 118/19
5,720,439 A * 2/1998 Nakazawa ..... B01J 2/14 241/21
5,904,951 A * 5/1999 Yamanaka ..... A23G 3/26 427/2.14
6,042,033 A * 3/2000 Sugimoto ..... B01F 7/166 241/46.02
6,264,989 B1 * 7/2001 Kato ..... A61K 9/1688 424/439
6,270,801 B1 * 8/2001 Walter ..... B01J 2/14 424/458
6,354,728 B1 * 3/2002 Bretschneider ..... A01C 1/06 366/286
6,612,733 B2 * 9/2003 Schmidt ..... B01F 7/00208 366/292
6,745,960 B1 * 6/2004 Myo ..... B01J 2/14 241/18
8,807,070 B2 * 8/2014 Jensen ..... B01J 2/006 118/303
9,113,753 B2 * 8/2015 Kafer ..... B01F 7/001
9,272,251 B2 * 3/2016 Jones ..... B01F 7/00275
9,854,813 B2 * 1/2018 Chiaramello ..... B01F 7/0025
10,099,186 B2 * 10/2018 Dunnebier ..... B01F 7/1675
11,045,034 B2 * 6/2021 De'Longhi ..... A47J 43/0727
2007/0139442 A1 * 6/2007 Robinson ..... B01F 15/00837 345/629
2007/0228201 A1 * 10/2007 Naito ..... B02C 19/10 241/107
2010/0309746 A1 * 12/2010 Andersson ..... B01F 7/162 366/165.3
2020/0398236 A1 * 12/2020 Motohashi ..... B01F 7/18
2020/0399825 A1 * 12/2020 Motohashi ..... D21B 1/063
2020/0399830 A1 * 12/2020 Motohashi ..... D21F 1/026
2021/0206019 A1 * 7/2021 Miyazawa ..... D21B 1/063

* cited by examiner

STIRRING APPARATUS

The present application is based on, and claims priority from JP Application Serial Number 2019-112944, filed Jun. 18, 2019, the disclosure of which is hereby incorporated by reference herein in its entirety.

BACKGROUND

1. Technical Field

The present disclosure relates to a stirring apparatus.

2. Related Art

To date, there are known sheet manufacturing apparatuses that produce recycled paper from used paper and that are provided with storage portions that store coarsely crushed paper pieces. Some of such storage portions are provided with stirring apparatuses that stir and feed a predetermined amount of paper pieces in order to stably supply the stored paper pieces in an amount that can be processed by a subsequent processing portion. Some of such stirring apparatuses are provided on a bottom surface with a stirring member that rotates in order to stir paper pieces stored therein and sends the paper pieces to a subsequent processing portion (for example, refer to JP-A-2011-241497).

However, in the existing configuration, the paper pieces may be compressed between the stirring member and a bottom surface of the storage portion, and the paper pieces may become clumped together. Then, in some cases, lump-shaped paper pieces are sent to a subsequent processing portion, and the load on the rotary driving device may be increased due to the supply of a predetermined amount or more of paper pieces to the processing portion or the compression of paper pieces between the rotary driving device and the bottom surface of the storage portion.

SUMMARY

According to an aspect of the present disclosure, a stirring apparatus includes a case that houses fiber pieces containing fibers, and a rotary body that is disposed inside the case and that stirs the fiber pieces, in which the rotary body includes a rotary portion that forms a portion of a bottom surface of the case and that rotates, and blades that stand upright on the rotary portion.

In the stirring apparatus, the blades may be disposed on imaginary lines extending radially from a rotation center of the rotary portion, and the rotary body may have, at a rotation center of the rotary portion, a protruding member that closes a space between the plurality of blades.

In the stirring apparatus, the protruding member may have a height that is higher than a height of the blades.

In the stirring apparatus, the blades may be provided from the protruding member to a peripheral edge of the rotary portion.

In the stirring apparatus, a portion of an outer peripheral edge of the blades may protrude outward from a peripheral edge of the rotary portion.

In the stirring apparatus, in plan view of the rotary portion, the blades may include a plurality of blades having a first height and a plurality of blades having a second height that is less than the first height, the blades having the second height being disposed between the blades having the first height.

In the stirring apparatus, the case may include a bottom surface, the rotary portion may be configured to rotate with respect to the bottom surface, and a sealing member may be disposed between the bottom surface of the case and the rotary portion.

In the stirring apparatus, a discharge port through which the fiber pieces are discharged to an outside of the case may be provided on a side wall of the case, and the discharge port may overlap a portion of the blades in a height direction.

In the stirring apparatus, the case may have an opening through which the fiber pieces are charged from above the case, and an overhang portion that protrudes from the side wall of the case toward an inside of the case is disposed between the opening and the rotary body.

In the stirring apparatus, a side wall of the case may be inclined toward a rotation center of the rotary portion from a bottom portion to an upper portion.

DESCRIPTION OF EXEMPLARY EMBODIMENTS

Hereinafter, preferred embodiments of the present disclosure will be described in detail with reference to the drawings. Further, the embodiments described below do not limit the content of the present disclosure described in the claims. In addition, all of the configurations described below are not necessarily essential components of the disclosure.

Figure 1:
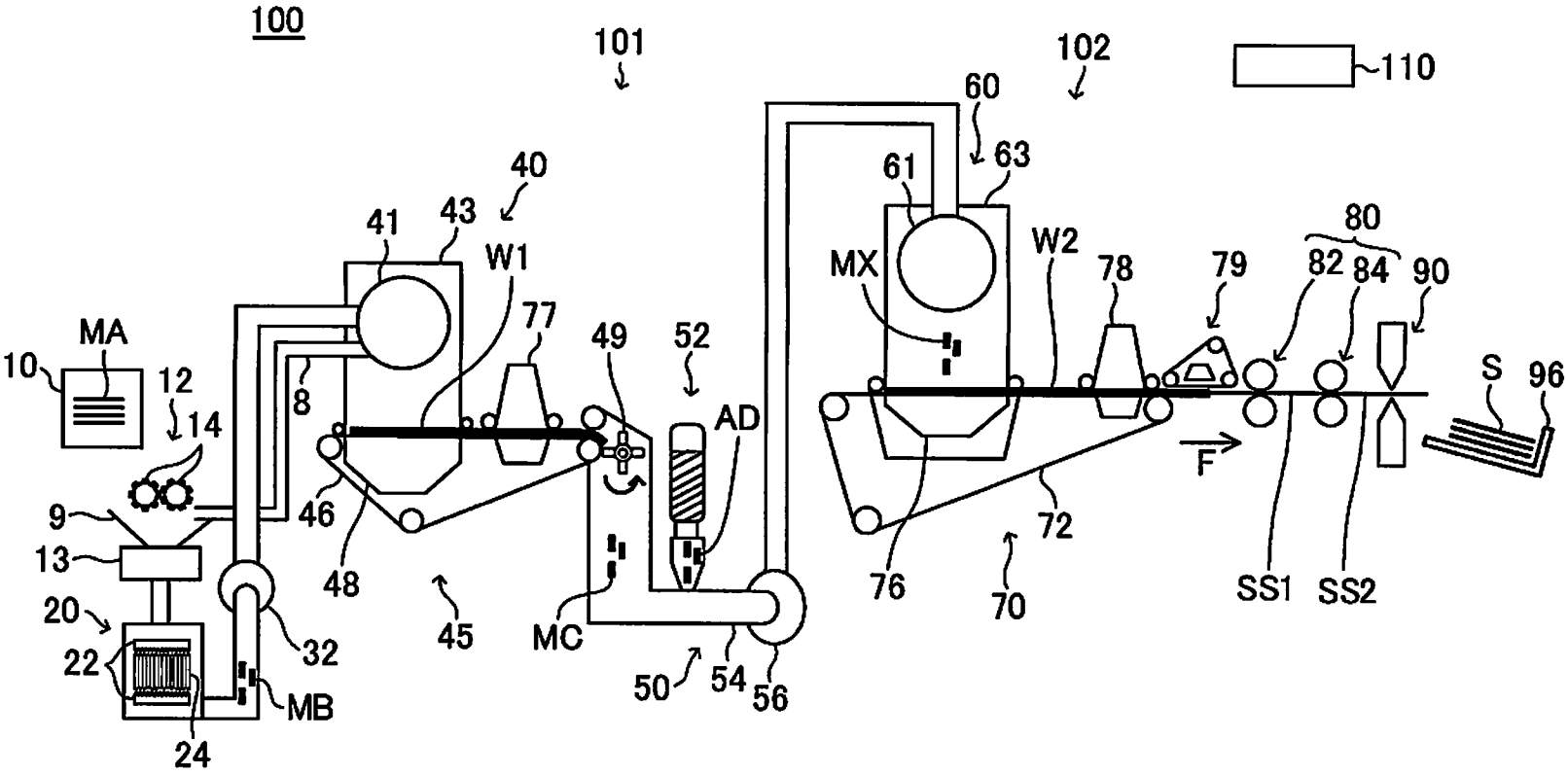
FIG. 1 is a schematic diagram illustrating a configuration of a sheet manufacturing apparatus.

FIG. 1 is a diagram illustrating a configuration of a sheet manufacturing apparatus 100.

The sheet manufacturing apparatus 100 converts a raw material MA containing fibers such as wood-based pulp material, craft pulp, waste paper, or synthetic pulp into fibers to manufacture a sheet S.

The sheet manufacturing apparatus 100 includes a supply portion 10, a crushing portion 12, a storage portion 13, a defibrating portion 20, a sorting portion 40, a first web forming portion 45, a rotary body 49, a mixing portion 50, a dispersing portion 60, a second web forming portion 70, a web transporting portion 79, a processing portion 80, and a cutting portion 90.

The supply portion 10 supplies the raw material MA to the crushing portion 12. The crushing portion 12 is a shredder that cuts the raw material MA with crushing blades 14. The raw material MA cut into paper pieces by the crushing portion 12 is collected by a hopper 9 and transported to the storage portion 13.

The storage portion 13 temporarily stores the raw material MA made up of fiber pieces supplied from the crushing portion 12, and supplies a predetermined amount to the defibrating portion 20. This makes it possible to maintain the raw material MA to be supplied to the process for manufacturing the sheet S in a predetermined amount.

The defibrating portion 20 defibrates the fine pieces cut in the crushing portion 12 by drying the fine pieces to obtain a defibrated material MB. The defibration is a process of unraveling the raw material MA, which is in a state where a plurality of fibers are bound, into one or a small number of fibers. The drying refers to performing a process such as defibration in an atmosphere, such as air, instead of in a liquid. The defibrated material MB contains components derived from the raw material MA, such as fibers contained in the raw material MA, resin particles, coloring agents such as ink and toner, bleeding suppression materials, and paper strength enhancers.

The defibrating portion 20 is, for example, a mill that includes a stator 22, which is cylindrical, and a rotor 24 that rotates inside the stator 22, and defibrates by holding coarsely crushed pieces between the stator 22 and the rotor 24. The defibrated material MB is sent to the sorting portion 40 through a pipe.

The sorting portion 40 has a drum portion 41 and a housing portion 43 that houses the drum portion 41. The drum portion 41 is a sieve having openings such as a net, a filter, or a screen, and is rotated by the power of a motor (not illustrated). The defibrated material MB is loosened inside the drum portion 41, which is rotating, and descends through the openings of the drum portion 41. The components of the defibrated material MB that do not pass through the openings of the drum portion 41 are transported to the hopper 9 through a pipe 8.

The first web forming portion 45 includes a mesh belt 46 that is endless and that has a large number of openings. The first web forming portion 45 manufactures a first web W1 by accumulating fibers or the like descending from the drum portion 41 onto the mesh belt 46. Among the components descending from the drum portion 41, those smaller than the openings of the mesh belt 46 pass through the mesh belt 46 and are suctioned and removed by a suction portion 48. As a result, among the components of the defibrated material MB, short fibers, resin particles, ink, toner, anti-smearing agent, and the like, which are not suitable for manufacturing the sheet S, are removed.

A humidifier 77 is disposed on the movement path of the mesh belt 46, and the first web W1 accumulated on the mesh belt 46 is humidified by mist-like water or high-humidity air.

The first web W1 is transported by the mesh belt 46 and comes into contact with the rotary body 49. The rotary body 49 divides the first web W1 with a plurality of blades to obtain a material MC. The material MC is transported to the mixing portion 50 through a pipe 54.

The mixing portion 50 includes an additive supply portion 52 that adds an additive material AD to the material MC, and a mixing blower 56 that mixes the material MC and the additive material AD. The additive material AD includes a binding material such as a resin for binding a plurality of fibers, and may include a colorant, an aggregation inhibitor, a flame retardant, and the like. The mixing blower 56 generates an airflow in the pipe 54 through which the material MC and the additive material AD are transported, mixes the material MC and the additive material AD, and transports the mixture MX to the dispersing portion 60.

The dispersing portion 60 includes a drum portion 61 and a housing 63 that houses the drum portion 61. The drum portion 61 is a cylindrical sieve formed similarly to the drum portion 41, and is driven by a motor (not illustrated) so as to rotate. By the rotation of the drum portion 61, the mixture MX is loosened and descends inside the housing 63.

The second web forming portion 70 includes a mesh belt 72 that is endless and that has a large number of openings. The second web forming portion 70 produces a second web W2 by accumulating the mixture MX descending from the drum portion 61 onto the mesh belt 72. Among the components of the mixture MX, those smaller than the openings of the mesh belt 72 pass through the mesh belt 72 and are sucked by a suction portion 76.

A humidifier 78 is disposed on the movement path of the mesh belt 72, and the second web W2 accumulated on the mesh belt 72 is humidified by mist-like water or high-humidity air.

The second web W2 is peeled off from the mesh belt 72 by the web transporting portion 79 and is transported to the processing portion 80. The processing portion 80 includes a pressing portion 82 and a heating portion 84. The pressing portion 82 holds the second web W2 between a pair of pressing rollers and presses the second web W2 with a predetermined nip pressure to form a pressed sheet SS1. The heating portion 84 applies heat across the sheet SS1 after the sheet SS1 has been pressed by a pair of heating rollers. Thereby, the fibers contained in the sheet SS1 after being pressed are bound by the resin contained in the additive material AD, and the sheet SS2 is formed after heating. The heated sheet SS2 is transported to the cutting portion 90.

The cutting portion 90 cuts the heated sheet SS2 in a direction intersecting with the transport direction F and/or in a direction along the transport direction F to produce a sheet S of a predetermined size. The sheet S is stored in a discharge portion 96.

The sheet manufacturing apparatus 100 includes a control device 110. The control device 110 controls each portion of the sheet manufacturing apparatus 100 including the defibrating portion 20, the additive supply portion 52, the mixing blower 56, the dispersing portion 60, the second web forming portion 70, the processing portion 80, and the cutting portion 90, and causes the method of manufacturing the sheet S to be executed. In addition, the control device 110 may control the operations of the supply portion 10, the sorting portion 40, the first web forming portion 45, and the rotary body 49.

Next, the configuration of the storage portion 13 will be described.

Figure 2:
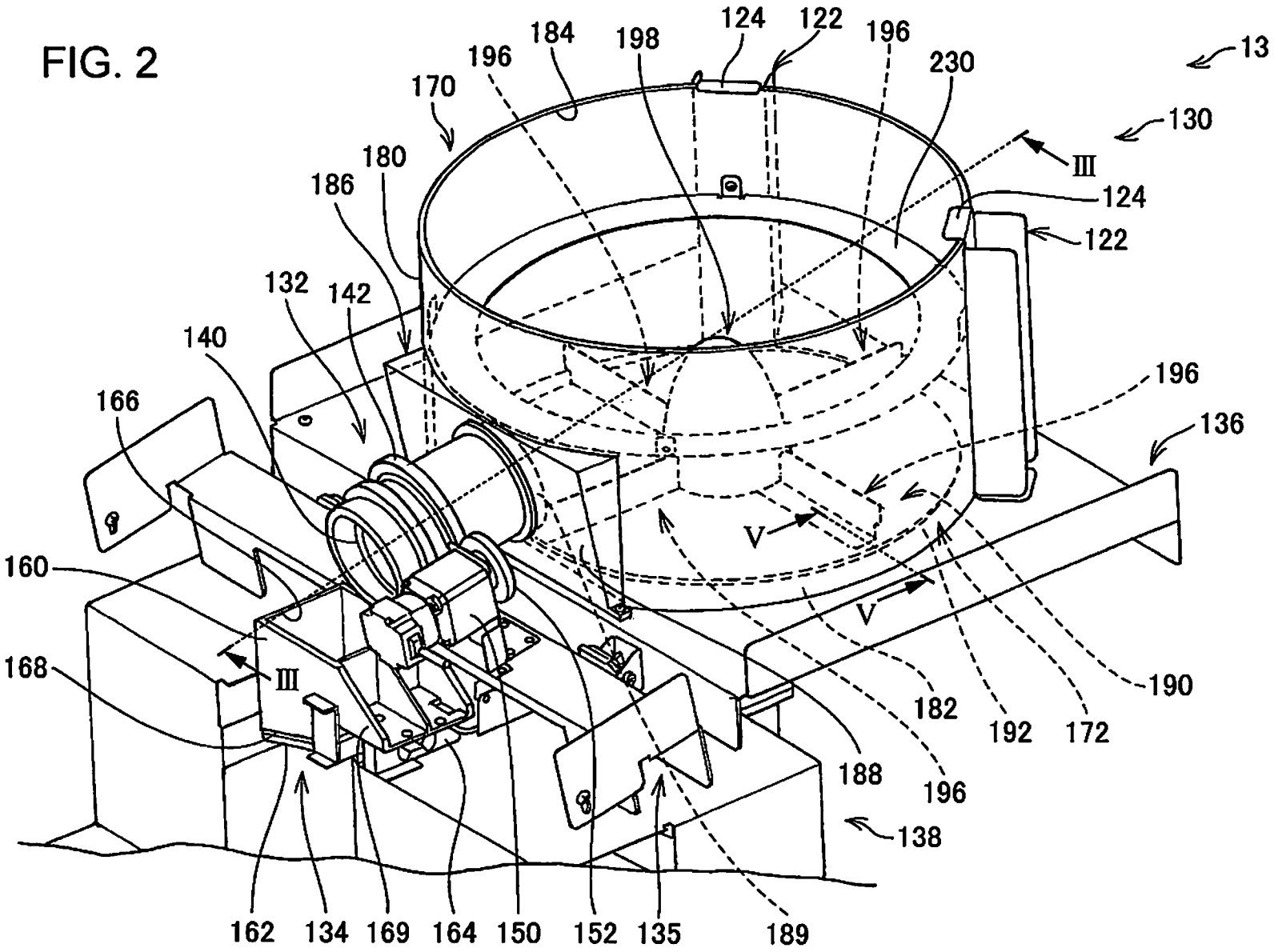
FIG. 2 is a perspective view of a storage portion.

FIG. 2 is a perspective view of the storage portion 13. In FIG. 2, only some of support members 122 are illustrated, and the other members are omitted.

The storage portion 13 of the present embodiment includes a stirring apparatus 130, a discharge pipe 132, and a measuring portion 134.

Figure 3:
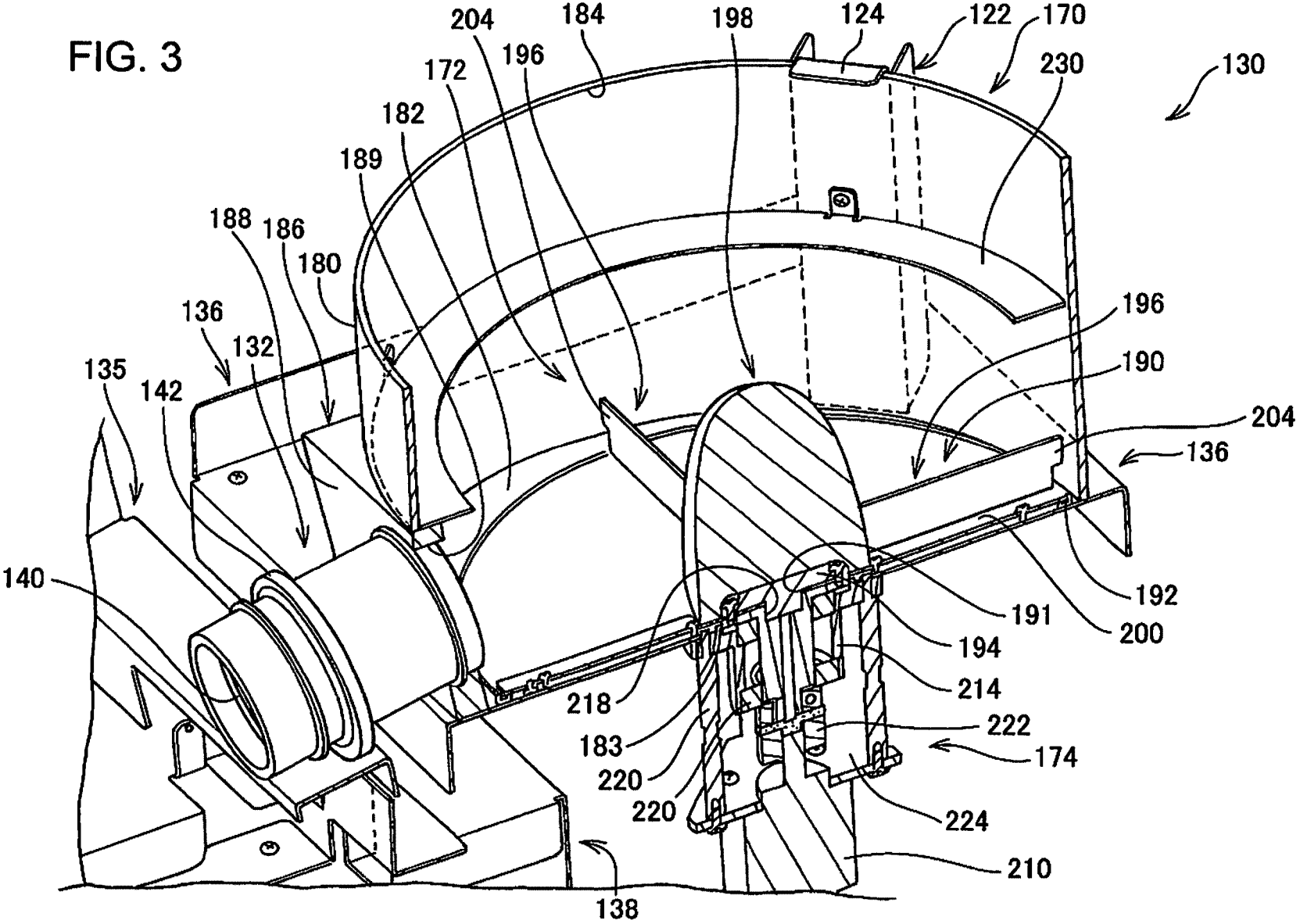
FIG. 3 is a vertical sectional perspective view taken along line III-III in FIG. 2.
Figure 4:
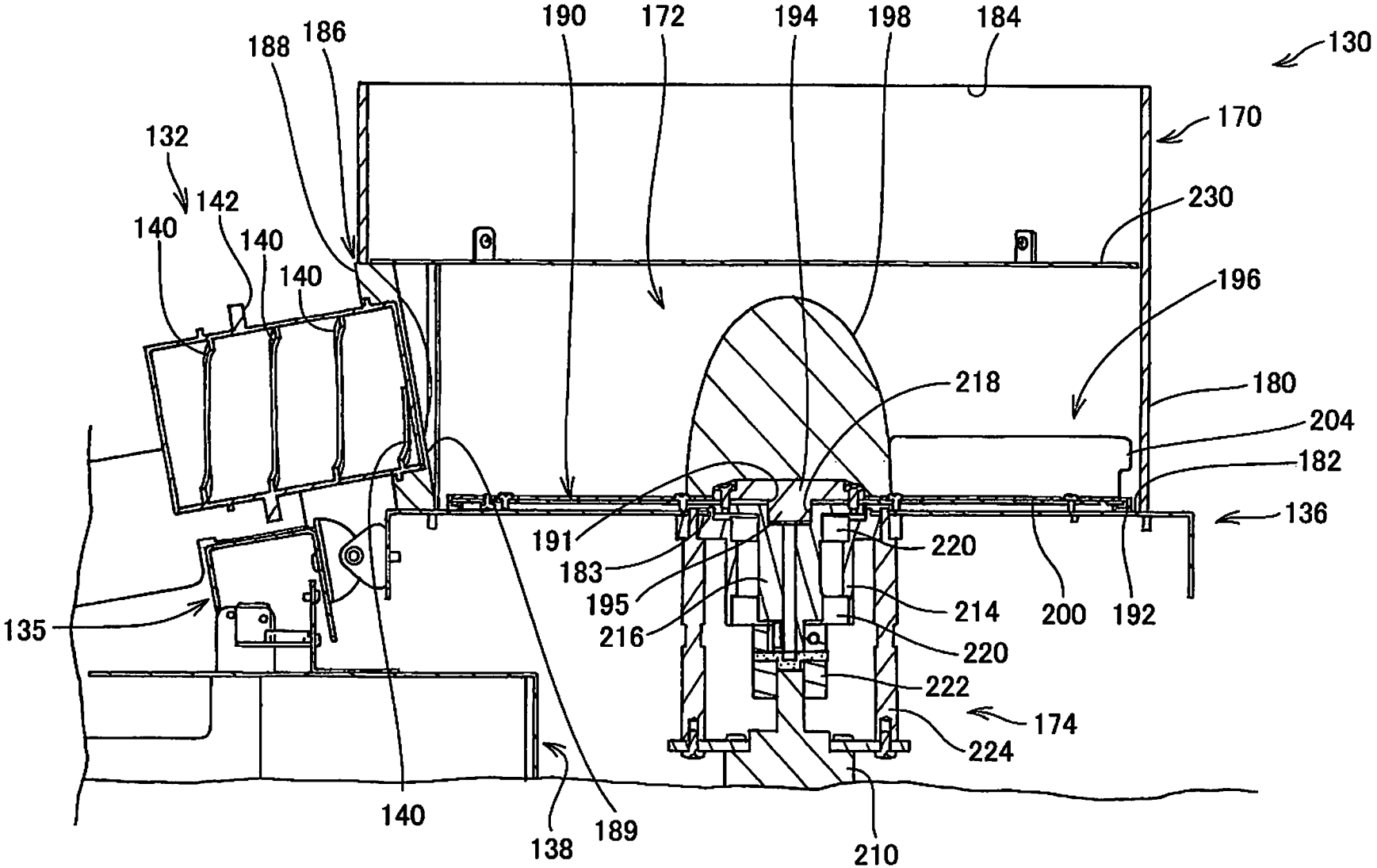
FIG. 4 is a longitudinal sectional view taken along line III-III in FIG. 2.

FIG. 3 is a vertical sectional perspective view taken along the line in FIG. 2, and FIG. 4 is a vertical sectional view taken along the line in FIG. 2. In FIG. 3, the cross section of the discharge pipe 132 is omitted. In addition, in FIGS. 3 and 4, the measuring portion 134 is omitted.

The stirring apparatus 130 is provided on an upper surface of a mounting table 136, and temporarily stores therein the raw material MA, which is made up of paper-like fiber pieces, transported from the hopper 9, and stirs the raw material MA. As illustrated in FIGS. 3 and 4, the stirring apparatus 130 includes a case 170, a rotary body 172, and a driving mechanism 174.

The case 170 is a cylindrical member that stores the raw material MA charged from the hopper 9, and the case 170 is formed by mounting a side wall 180 on the mounting table 136.

The side wall 180 is fixed to the mounting table 136 by being supported by a plurality of the support members 122. As illustrated in FIG. 3, each of the support members 122 is a plate member having three surfaces. Each of the support members 122 is disposed on the upper surface of the mounting table 136 and extends vertically along the side wall 180. Further, in FIG. 3, only one of the support members 122 is illustrated, and the other members are omitted.

Each of the support members 122 includes a claw portion 124 at an upper end, and each of the claw portions 124 is engaged with an upper end of the side wall 180, whereby the side wall 180 is fixed to the mounting table 136.

An overhang portion 230 is provided on an inner side surface of the side wall 180 over the entire circumferential direction. The overhang portion 230 is an annular plate member, and the overhang portion 230 is supported by the plurality of support members 122 provided along the outer surface of the side wall 180.

The overhang portion 230 is fixed to each of the support members 122 via the side wall 180 by a screw member. That is, the side wall 180 together with the overhang portion 230 is fixed to each of the support members 122 by a screw member.

In the present embodiment, the overhang portion 230 is fixed so as to be located at a height approximately half the height of the side wall 180.

By providing the overhang portion 230, when the raw material MA charged into the stirring apparatus 130 is stirred, it is possible to suppress the raw material MA from being flung upward and from overflowing from an opening portion 184 due to the presence of the overhang portion 230.

Further, the side wall 180 and the overhang portion 230 may be formed integrally. In addition, the height at which the overhang portion 230 is provided and the overhang length may be adjusted according to the shape and size of the stirring apparatus 130 and the processing speed.

A bottom surface 182 of the case 170 is an upper surface of the mounting table 136 surrounded by the side wall 180.

In top view of the bottom surface 182, a bottom hole 183, which is a through hole, is provided at a position corresponding to the center of a rotary portion 190 described later.

Further, the bottom surface 182 of the case 170 may be formed as a member provided separately from the top surface of the mounting table 136.

The opening portion 184 is provided at the upper end of the case 170.

The hopper 9 is disposed above the case 170, that is, in a direction away from the bottom surface 182 of the case, and the stirring apparatus 130 can charge the raw material MA from the hopper 9 into the case 170 through the opening portion 184.

A discharge portion 186 is provided on the side wall 180 of the case 170. The discharge portion 186 is a box-shaped member provided so as to overhang outward from below the side wall 180 facing the measuring portion 134, and the discharge portion 186 has a hollow interior.

The discharge portion 186 is provided with an inclined surface 188 at a position facing the measuring portion 134. The inclined surface 188 is provided to be inclined upward in a direction approaching the measuring portion 134.

The inclined surface 188 is provided with a discharge port 189 that enables communication between the inside of the case 170 and the outside. The raw material MA stored inside the case 170 is discharged to the outside of the case 170 through the discharge port 189.

The rotary body 172 is a member provided so as to rotate with respect to the bottom surface 182, and the rotary body 172 stirs the raw material MA charged inside the case 170. The rotary body 172 includes the rotary portion 190, a sealing member 192, a plurality of blades 196, and a protruding member 198.

The rotary portion 190 is a disk-shaped member having a smaller diameter than the bottom surface 182, and the rotary portion 190 is disposed so as to be parallel to the bottom surface 182 at a predetermined distance from the side wall 180 such that the peripheral edge thereof does not contact the side wall 180. The rotary portion 190 forms a portion of the bottom surface 182 in top view.

The center of the rotary portion 190 in top view is located at a position different from the center of the bottom surface 182 in top view. The center of the rotary portion 190 in top view is located at a position farther from the discharge portion 186 in the radial direction of the rotary portion 190 than the center of the bottom surface 182 in top view.

A center hole 191 that is a through hole is provided at the rotation center of the rotary portion 190.

The rotary portion 190 is rotatably supported by the driving mechanism 174 described later.

The sealing member 192 is a member that closes the space between the rotary portion 190 and the bottom surface 182, and the sealing member 192 is provided over the entire peripheral edge of the rotary portion 190.

Thus, when the raw material MA is charged into the case 170, the raw material MA is suppressed from entering the space between the rotary portion 190 and the bottom surface 182. For this reason, the raw material MA is suppressed from being compressed between the rotary portion 190 and the bottom surface 182 and forming lumps.

In the present embodiment, the sealing member 192 is formed of, for example, a resin such as polyacetal.

The plurality of blades 196 are members that stir the raw material MA with the rotation of the rotary body 172, and, on the upper surface of the rotary portion 190, the blades 196 are disposed on imaginary lines extending radially from the rotation center of the rotary portion 190. In the present embodiment, the rotary body 172 is provided with four blades 196 at predetermined intervals in the circumferential direction of the rotary portion 190.

A flange 200 is formed on the lower edge of each of the blades 196 so as to be substantially perpendicular to the blade 196. Each of the blades 196 is fixed by the flange 200 being in surface contact with the upper surface of the rotary portion 190 and attached thereto by screw members.

The height of each of the blades 196 is formed to be smaller than the diameter of the discharge port 189. Thus, inside the case 170, a sufficient space is provided above the rotary body 172, and the raw material MA is sufficiently stirred by the rotation of the rotary body 172.

In the present embodiment, the blades 196 are stood upright substantially vertically; however, the present disclosure is not limited to this and an angle formed by the blade 196 and the upper surface of the rotary portion 190 is not limited to vertical, but may be an acute angle or an obtuse angle.

An end portion of each of the blades 196 that is located on the center side of the rotary body 172 is disposed at a position close to a coupling member 194, and an end portion of each of the blades 196 that is located on the outer peripheral side of the rotary body 172 is disposed on the peripheral edge of the rotary portion 190. That is, the longitudinal direction of each of the blades 196 extends from near the rotation center of the rotary portion 190 to the peripheral edge.

Consequently, when the rotary body 172 rotates, the raw material MA charged inside the case 170 can be stirred over a wider range in the radial direction of the case 170.

Figure 5:
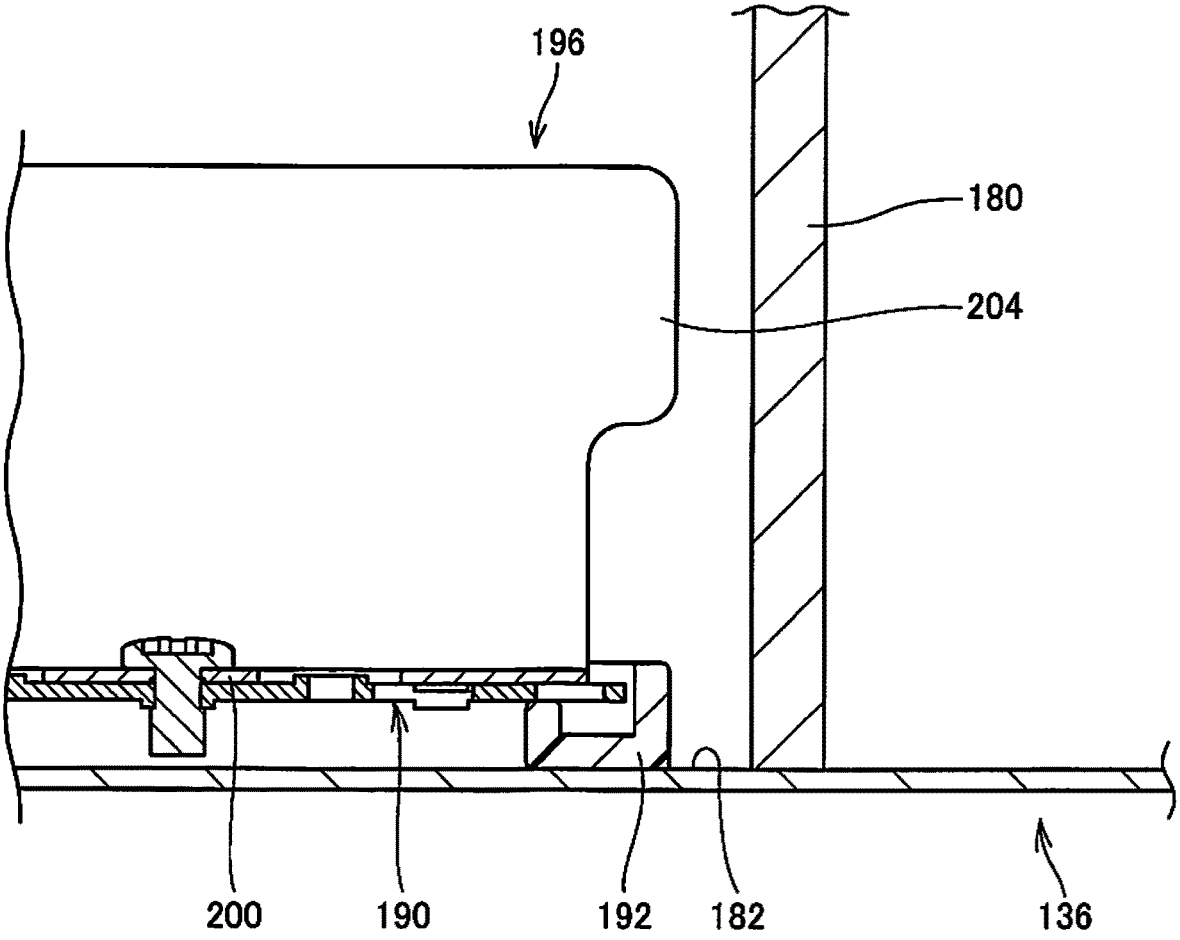
FIG. 5 is a vertical sectional view taken along line V-V in FIG. 2.

FIG. 5 is a longitudinal sectional view taken along line V-V in FIG. 2.

As illustrated in FIG. 5, a protruding piece 204 that protrudes outward in the radial direction of the rotary portion 190 is provided on the outer peripheral edge of the blade 196. The protruding piece 204 is provided above the outer peripheral edge of the blade 196, and at least a portion of the protruding piece 204 overlaps the discharge port 189 in the height direction of the case 170 in side view of the case 170.

Thus, when the blade 196 stirs the raw material MA, the blade 196 can push the raw material MA into the discharge port 189, and can more efficiently send the raw material MA from the discharge port 189 to the discharge pipe 132.

As illustrated in FIGS. 3 and 4, the protruding member 198 is a member disposed at the rotation center of the upper surface of the rotary portion 190, and the protruding member 198 of the present embodiment has a semi-elliptical sphere shape. The protruding member 198 covers the coupling member 194 and is coupled to an end portion of each of the blades 196 located on the center side of the rotary body 172 without any gap therebetween.

The height dimension of the protruding member 198 is higher than the height dimension of each of the blades 196, and in this embodiment, is about half the height dimension of the side wall 180.

Conventionally, the protruding member 198 is not disposed at the rotation center of the rotary portion 190. Thus, when the raw material MA is charged near the rotation center, the raw material is not stirred by the blades 196 even if the rotary body 172 is rotating, and the effect of centrifugal force generated by the rotation of the rotary body 172 is suppressed. For this reason, the material MA may be suppressed from accumulating near the rotation center and being discharged from the inside of the case 170.

In addition, in some cases, the raw material MA accumulated on the rotation center of the rotary portion 190 is discharged from the discharge port 189 after forming lumps, so that a predetermined amount or more of the raw material MA is supplied to the defibrating portion 20.

In the present embodiment, by providing the protruding member 198, the space at the rotation center of the rotary portion 190 is closed, and accumulation of the raw material MA in the spaces between the blades 196 near the rotation center is suppressed.

Furthermore, the height dimension of the protruding member 198 is higher than the height dimension of each of the blades 196. Thus, accumulation of the raw material MA on the rotation center of the rotary portion 190 and above each of the blades 196 can be suppressed.

Further, the shape of the protruding member 198 may be that of a cone or a pyramid, or a shape in which the tip of a cone is formed in a spherical shape.

The driving mechanism 174 is a member that rotationally drives the rotary body 172, and the driving mechanism 174 is disposed below the mounting table 136. The driving mechanism 174 includes a stirring motor 210, a housing member 214, a drive shaft 216, and the coupling member 194.

The housing member 214 is a cylindrical housing that houses the drive shaft 216, and one end portion of the housing member 214 is coupled to the lower surface of the mounting table 136 so as to cover the bottom hole 183.

The drive shaft 216 is a rod-shaped member housed inside the housing member 214, and one end portion of the drive shaft 216 in the longitudinal direction is inserted into the bottom hole 183 and coupled to a lower surface of the rotary portion 190. At one end portion of the drive shaft 216 in the longitudinal direction, a recessed portion 218 that is depressed toward the other end portion is provided. The recessed portion 218 is formed to have substantially the same diameter as the center hole 191. The drive shaft 216 is supported by the housing member 214 via two bearings 220.

The other end portion of the drive shaft 216 in the longitudinal direction protrudes from the housing member 214 and is coupled to the stirring motor 210 via a coupling member 222.

The stirring motor 210 is fixed to the mounting table 136 via a fixing member 224.

The coupling member 194 is a member that couples the driving mechanism 174 to the rotary portion 190, and an insertion portion 195 that protrudes downward is provided on the lower surface of the coupling member 194. The coupling member 194 is disposed on the upper surface of the rotary portion 190 so as to cover the center hole 191, and the insertion portion 195 is inserted into the center hole 191 and the recessed portion 218. The coupling member 194 is fixed to the rotary portion 190 and the drive shaft 216 by a plurality of screw members.

Next, the discharge pipe 132 will be described.

As illustrated in FIG. 2, the discharge pipe 132 is a tubular member having one end portion coupled to the discharge port 189 and sending out the raw material MA stored in the stirring apparatus 130 to the measuring portion 134.

The discharge pipe 132 has a predetermined length and a tubular shape having both ends open, and one end portion of the discharge pipe 132 is rotatably coupled to the stirring apparatus 130, and the other end portion is disposed at a position close to the measuring portion 134. In the present embodiment, the other end portion is disposed below the upper surface of the mounting table 136. That is, the discharge pipe 132 is provided so as to be inclined downward in the longitudinal direction in side view.

A spiral member 140 is provided on an inner surface of the discharge pipe 132. The spiral member 140 is erected at a predetermined height toward a center axis in the longitudinal direction of the discharge pipe 132.

A driven gear 142 is provided on the outer surface of the discharge pipe 132 over the entire circumferential direction.

A transport motor 150 is provided at a location adjacent to the discharge pipe 132. The transport motor 150 is attached to an upper surface of a support member 135 provided on a side surface of the mounting table 136. The transport motor 150 is provided with a drive gear 152 that is disk-shaped. The drive gear 152 meshes with the driven gear 142.

Thus, the discharge pipe 132 is driven to rotate in the circumferential direction by driving of the transport motor 150.

The measuring portion 134 is located below the other end portion of the discharge pipe 132, is supported by a support 138, and stores the raw material MA discharged from the other end portion of the discharge pipe 132 until a predetermined amount is reached. The measuring portion 134 includes a receiving portion 160, a closing member 162, and a load cell 164.

The receiving portion 160 is a box-shaped member having a capacity capable of storing a predetermined amount of the raw material MA therein, and an upper-surface opening portion 166 is provided on the upper surface of the receiving portion 160. The other end portion of the discharge pipe 132 is disposed above the upper-surface opening portion 166.

A lower-surface opening portion 168 is provided on the lower surface of the receiving portion 160.

A fixing portion 169 is provided on the outer surface of the receiving portion 160. The fixing portion 169 protrudes outward from a predetermined location on the outer surface of the receiving portion 160. The fixing portion 169 is fixed to the load cell 164 with the lower surface of the fixing portion 169 in contact with the upper surface of the load cell 164. That is, the receiving portion 160 is supported by the load cell 164.

The closing member 162 is a plate-like member that closes the lower-surface opening portion 168. The closing member 162 is pivotally fixed to the receiving portion 160, and the closing member 162 is configured to pivot between a closed position in which the lower-surface opening portion 168 is closed and an open position in which the lower-surface opening portion 168 is open.

The closing member 162 includes an opening and closing motor (not illustrated) driven by the control device 110, and the closing member 162 is pivoted by driving the opening and closing motor.

Specifically, the closing member 162 is normally disposed at the closed position, and moves to the open position when the opening and closing motor is driven.

Further, the closing member 162 may be provided so as to be movable between a closed position and an open position by sliding like a shutter.

The load cell 164 is a sensor that detects a force such as weight or torque, and outputs a predetermined signal in accordance with the detected force. The load cell 164 is mounted and fixed on the support 138, and the fixing portion 169 is fixed to the upper surface of the load cell 164 as described above.

In the present embodiment, the load cell 164 measures the weight of the receiving portion 160, and outputs a predetermined signal to the control device 110 when the receiving portion 160 reaches a specified weight. Accordingly, the control device 110 drives the opening and closing motor, and the closing member 162 moves from the closed position to the open position.

Further, the measuring portion 134 is not limited to the load cell 164, and another detector capable of detecting the weight may be used.

Next, the processing operation of the storage portion 13 of the present embodiment will be described.

When the sheet manufacturing apparatus 100 is started, the transport motor 150 and the stirring motor 210 are driven, and the rotary body 172 and the discharge pipe 132 are driven to rotate.

When the raw material MA is put into the case 170 from the hopper 9, it is stirred by the rotary body 172. The raw material MA is flung upward by each of the blades 196 and, at the same time, sent out in the peripheral direction of the rotary body 172, that is, in the direction of the side wall 180. By stirring in this manner, even when a plurality of types of raw materials MA having different densities, thicknesses, colors, and the like are charged, it is possible to suppress the raw materials MA from being homogenized inside the case 170 and forming lumps.

The raw material MA that has been stirred is sent out from the discharge port 189 to the discharge pipe 132 by each of the blades 196. Inside the discharge pipe 132, which is rotating, the raw material MA is sent out to the measuring portion 134 by the spiral member 140.

The raw material MA sent out to the measuring portion 134 is charged into the receiving portion 160 through the upper-surface opening portion 166. When the load cell 164 detects that a predetermined amount of the raw material MA has been charged into the receiving portion 160 and has reached the specified weight, the control device 110 drives the opening and closing motor. Consequently, the closing member 162 is rotated to move from the closed position to the open position, and the raw material MA in the receiving portion 160 falls downward and is transported to the defibrating portion 20.

Further, the rotary body 172 and the discharge pipe 132 can rotate in opposite directions, stop rotation, and change rotational speed in accordance with the processing state of the sheet manufacturing apparatus 100. By controlling such an operation, the discharge amount of the raw material MA by the discharge pipe 132 can be adjusted.

In addition, these processing operations in the storage portion 13 are performed in an atmosphere, such as in air, as in the defibrating portion 20.

As described above, in the rotary body 172, each of the blades 196 and the rotary portion 190 forming a portion of the bottom surface 182 rotate together. Consequently, it is possible to suppress the raw material MA from being compressed between each of the blades 196 and the bottom surface 182 and forming lumps. Therefore, it is possible to suppress the raw material MA from staying inside the case 170 and to suppress the raw material MA that has formed lumps from being discharged, and the stirring apparatus 130 stably discharges a predetermined amount of the raw material MA from the discharge port 189.

According to the above-described embodiment, the following effects can be obtained.

The stirring apparatus 130 of the present embodiment includes the case 170 that houses the raw material MA, and the rotary body 172 that is disposed inside the case 170 and that stirs the raw material MA. The rotary body 172 includes the rotary portion 190 that forms a portion of the bottom surface 182 of the case 170 and that rotates, and a plurality of the blades 196 provided on the rotary portion 190.

Consequently, it is possible to suppress the raw material MA from being compressed and forming lumps between each of the blades 196 and the bottom surface 182. Therefore, it is possible to suppress the raw material MA from staying in the case 170 and to suppress the raw material MA that has formed lumps from being discharged, and the stirring apparatus 130 stably discharges a predetermined amount of the raw material MA from the discharge port 189. In addition, it is possible to suppress a load on the driving mechanism 174 due to the compression of the raw material MA.

In addition, according to the present embodiment, each of the blades 196 is disposed on an imaginary line extending radially from the rotation center of the rotary portion 190, and the rotary portion 190 is, at the rotation center of the rotary portion 190, provided with the protruding member 198 that closes a space between the blades 196. Consequently, the space at the rotation center of the rotary portion 190 is closed, and the accumulation of the raw material MA in the space between the blades 196 near the rotation center is suppressed.

In addition, according to the present embodiment, the height of the protruding member 198 is higher than the height of each of the blades 196. Consequently, accumulation of the raw material MA at the rotation center of the rotary portion 190 and above each of the blades 196 can be suppressed.

In addition, according to the present embodiment, each of the blades 196 is provided from the protruding member 198 up to the peripheral edge of the rotary portion 190. Thus, when the rotary body 172 rotates, the raw material MA charged into the case 170 can be stirred over a wider range in the radial direction of the case 170.

In addition, according to the present embodiment, the protruding piece 204 that protrudes outward in the radial direction of the rotary portion 190 from the peripheral edge of the rotary portion 190 is provided at a distal end of the blade 196 in the longitudinal direction of the blade 196, which is located at the outer peripheral edge of the rotary portion 190. Thus, when the blade 196 stirs the raw material MA, the blade 196 can push the raw material MA into the discharge port 189, and the raw material MA is discharged from the discharge port 189 more efficiently.

In addition, according to the present embodiment, the case 170 includes the bottom surface 182, the rotary portion 190 is configured to rotate with respect to the bottom surface 182, and the sealing member 192 is disposed between the bottom surface of the case 170 and the rotary portion 190. Consequently, when the raw material MA is charged into the case 170, it is possible to suppress the raw material MA from entering between the rotary portion 190 and the bottom surface 182. In addition, it is possible to suppress the load on the driving mechanism 174 due to compression of the raw material MA between the rotary portion 190 and the bottom surface 182.

In addition, according to the present embodiment, the discharge port 189 for discharging the raw material MA to the outside of the case 170 is provided on the side wall 180 of the case 170, and the discharge port 189 is disposed at a position overlapping the protruding piece 204 of each of the blades 196 in the height direction of the case 170. Consequently, when the blade 196 stirs the raw material MA, the blade 196 can push the raw material MA into the discharge port 189, and therefore can more efficiently send the raw material MA out from the discharge port 189 to the discharge pipe 132.

In addition, according to the present embodiment, the case 170 has the opening portion 184 into which the raw material MA can be charged from above the case 170, and the overhang portion 230 that protrudes from the side wall 180 of the case 170 toward the inside of the case 170 is disposed between the opening portion 184 and the rotary body 172. Consequently, when the raw material MA charged into the stirring apparatus 130 is stirred, it is possible to suppress the raw material MA from being flung upward and from overflowing from the opening portion 184 due to the presence of the overhang portion 230.

Next, a first modification of the present disclosure will be described.

Figure 6:
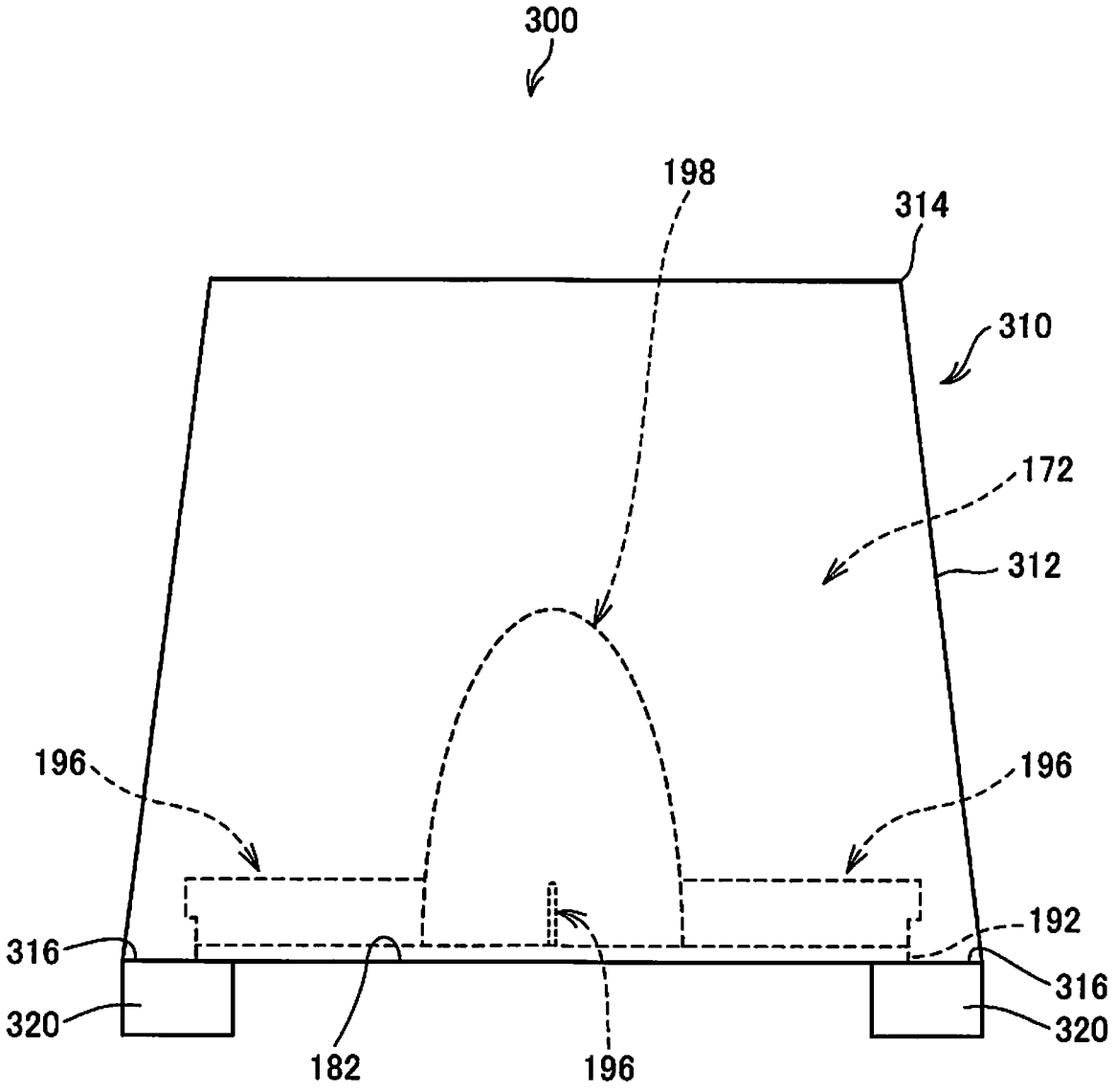
FIG. 6 is a side view illustrating a schematic configuration of a stirring apparatus according to a first modification of the present disclosure.

FIG. 6 is a side view illustrating a schematic configuration of a stirring apparatus 300 according to the first modification of the present disclosure. In FIG. 6, the same portions as those in FIGS. 2, 3, and 4 are denoted by the same reference signs, and description thereof will be omitted.

The stirring apparatus 300 of this modification is the same as the stirring apparatus 130 of the above-described embodiment except that a side wall 312 of a case 310 is an inclined surface that is inclined in side view of the case 310, and that a discharge port 316 is provided on the bottom surface 182.

The stirring apparatus 300 of this modification has a plurality of the discharge ports 316 provided on the bottom surface 182 of the case 310 provided in the stirring apparatus 300. The raw material MA charged into the case 310 is stirred by the rotary body 172 and discharged from each of the discharge ports 316, and is sent out to a discharge pipe 320 provided at each of the discharge ports 316.

Further, the discharge ports 316 may be provided on the side wall 312 of the case 310 or on the side wall 180 as illustrated in FIG. 2.

The side wall 312 is formed as an inclined surface inclined from the bottom surface 182, which has been mounted, to an opening portion 314, that is, from a bottom portion to an upper portion, toward the rotation center of the rotary portion 190. For this reason, the case 310 has a truncated cone shape.

Thereby, the stirring by the rotary body 172 is performed more efficiently. In addition, since the inner side surface of the side wall 312 is inclined toward the inside of the case 310, it is possible to suppress the raw material MA from being flung up above the opening portion 314 and from overflowing from the opening portion 314 due to the presence of the inner side surface of the side wall 312.

Next, a second modification of the present disclosure will be described.

Figure 7:
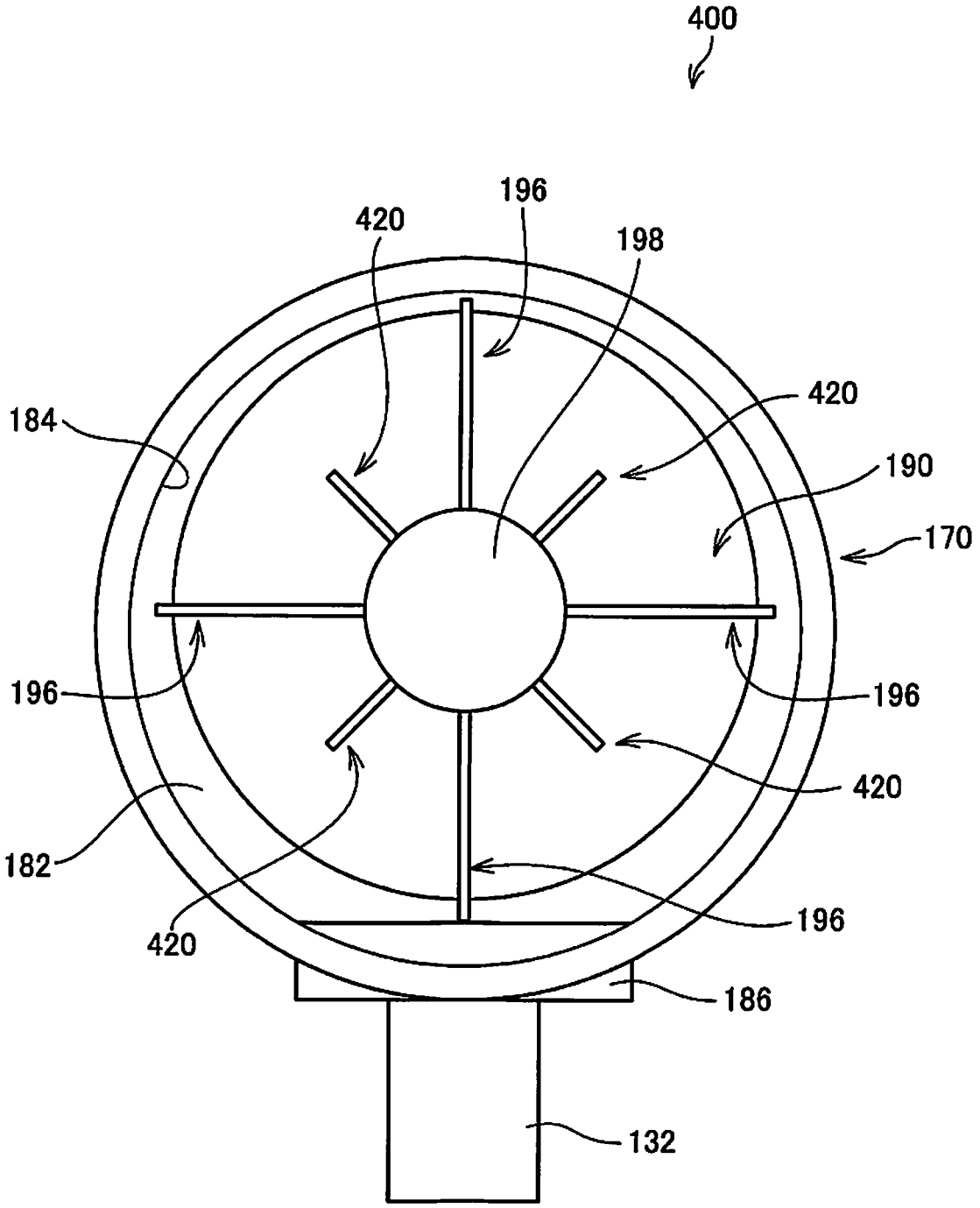
FIG. 7 is a top view illustrating a schematic configuration of a stirring apparatus according to a second modification of the present disclosure.

FIG. 7 is a top view illustrating a schematic configuration of a stirring apparatus 400 according to a second modification of the present disclosure. In FIG. 7, the same portions as those in FIGS. 2, 3, and 4 are denoted by the same reference signs, and description thereof will be omitted.

The stirring apparatus 400 of this modification is the same as the stirring apparatus 130 of the above-described embodiment, except that a rotary body 410 is provided with four blades 420.

The rotary body 410 provided in the stirring apparatus 400 of this modification has the blades 420 provided between the respective blades 196. Each of the blades 196 and each of the blades 420 are radially disposed in plan view of the rotary portion 190.

The length of each of the blades 420 in the longitudinal direction is shorter than the length of each of the blades 196, and is a length that does not reach the peripheral edge of the rotary portion 190 from the protruding member 198. In addition, the height of each of the blades 420 is smaller than the height of each of the blades 196.

By providing the blades 420 in this manner, when the rotary body 410 rotates, it becomes possible to further stir the raw material MA charged near the center of rotation. In addition, the blades 196 having a predetermined height and the blades 420 having a height smaller than the blades 196 are alternately arranged, so that the stirring effect inside the case 170 can be enhanced.

Further, in this modification, the length of each of the blades 420 in the longitudinal direction may be the same as the length of each of the blades 196. In addition, the height of each of the blades 420 may be substantially the same as the height of each of the blades 196. Also, in these cases, the stirring effect inside the case 170 can be enhanced.

The above embodiment is an example of one embodiment of the present disclosure, and can be arbitrarily modified and applied without departing from the spirit of the present disclosure.

For example, in the embodiment described above, the processing operation in the storage portion 13 is performed in an atmosphere such as air, but is not limited thereto, and may be performed in a liquid such as water.

In addition, for example, a plurality of the discharge ports 189 and the discharge pipe 132 coupled to the discharge port 189 may be provided.

In addition, for example, in the above-described embodiment, the rotary portion 190 is a disk-shaped member, but is not limited thereto, and may be a conical member disposed so as to protrude upward.

What is claimed is:

1. A stirring apparatus comprising:

a case that houses fiber pieces containing fibers; and a rotary body that is disposed inside the case and that stirs the fiber pieces, the rotary body including a rotary portion that has a first surface and a second surface, and that rotates, the second surface facing in an opposite direction of the first surface and facing a bottom surface of the case, blades that are fixed to the first surface of the rotary portion and stand upright on the rotary portion, so as to integrally rotate with the rotary portion, and a sealing member disposed at least between the bottom surface of the case and the second surface of the rotary portion, and directly contacting the bottom surface of the case, and an outer peripheral edge portion of the second surface of the rotary portion.

2. The stirring apparatus according to claim 1, wherein the blades are disposed on imaginary lines extending radially from a rotation center of the rotary portion, and the rotary body has, at a rotation center of the rotary portion, a protruding member that closes a space between the plurality of blades.

3. The stirring apparatus according to claim 2, wherein the protruding member has a height that is higher than a height of the blades.

4. The stirring apparatus according to claim 2, wherein the blades are provided from the protruding member to a peripheral edge of the rotary portion.

5. The stirring apparatus according to claim 4, wherein a portion of an outer peripheral edge of the blades protrudes outward from a peripheral edge of the rotary portion.

6. The stirring apparatus according to claim 1, wherein in plan view of the rotary portion, the blades include a plurality of blades having a first height and a plurality of blades having a second height that is less than the first height, the blades having the second height being disposed between the blades having the first height.

7. The stirring apparatus according to claim 1, wherein the rotary body is configured to rotate with respect to the bottom surface of the case.

8. The stirring apparatus according to claim 1, wherein a discharge port through which the fiber pieces are discharged to an outside of the case is provided on a side wall of the case, and the discharge port overlaps a portion of the blades in a height direction.

9. The stirring apparatus according to claim 1, wherein the case has an opening through which the fiber pieces are charged from above the case, and an overhang portion that protrudes from the side wall of the case toward an inside of the case is disposed between the opening and the rotary body.

10. The stirring apparatus according to claim 1, wherein a side wall of the case is inclined toward a rotation center of the rotary portion from a bottom portion to an upper portion.

* * * * *